US006390617B1

(12) United States Patent
Iwao

(10) Patent No.: US 6,390,617 B1
(45) Date of Patent: May 21, 2002

(54) IMAGE FORMING APPARATUS

(75) Inventor: Naoto Iwao, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/398,187

(22) Filed: Sep. 17, 1999

(30) Foreign Application Priority Data

Sep. 29, 1998 (JP) ..... 10-275955

(51) Int. Cl.[7] ..... B41J 2/01
(52) U.S. Cl. ..... 347/102; 347/103
(58) Field of Search ..... 347/102, 103; 399/309, 45

(56) References Cited

U.S. PATENT DOCUMENTS 4,475,128 A * 10/1984 Koumura ..... 358/296
5,502,475 A * 3/1996 Kaburagi et al. ..... 347/102
5,502,476 A 3/1996 Neal et al. ..... 347/103

FOREIGN PATENT DOCUMENTS

JP A-7-276621 10/1995
JP A-8-67842 3/1996

* cited by examiner

*Primary Examiner*—John Barlow
*Assistant Examiner*—Craig A. Hallacher
(74) *Attorney, Agent, or Firm*—Oliff & Berridge, PLC

(57) ABSTRACT

The intermediate medium is an endless belt wound around and spans intermediate medium transport rollers and a transfer roller. Ink jet heads are disposed outside of the loop, their nozzles facing to the intermediate medium. A phase-changeable ink is ejected from the ink jet heads onto the intermediate medium to form an intermediate image. The intermediate image is pressed against a recording medium and transferred onto the recording medium whose surface to be recorded is directly heated in advance, and a final image is obtained. In this way, double-sided printing can be performed without any damage on the printed side.

21 Claims, 8 Drawing Sheets

IMAGE FORMING APPARATUS

BACKGROUND OF THE INVENTION

1. Field of Invention

The invention relates to an image forming apparatus, in which an image is first formed on an intermediate medium using phase-changeable ink, such as hot melt ink, and then transferred onto a recording medium. More particularly, it is related to an image forming apparatus that is capable of forming the image onto both sides of the recording medium by accurately controlling the surface temperature of the recording medium.

2. Description of Related Art

For the image forming apparatus whose printing method is ink jet printing, it is necessary to maintain a gap between ink jet heads and the side of the recording medium to be recorded with the image in order to obtain high-quality images. However, especially for the image forming apparatus whose printing method is ink jet printing, in which a final ink image is directly formed onto the recording medium, such as paper, it is difficult to maintain the gap between the heads and the recording medium constant because the gap is significantly changed if the thickness of the recording medium is changed. For the image forming apparatus whose printing method is thermal printing, changes in the size of the recording medium, in particular, for color printing using multicolor thermal heads, causes a problem that the ink images formed by the each of the heads is out of position.

Therefore, there have been proposed various image forming apparatuses whose printing methods are an intermediate transfer printing in which an intermediate image is temporarily formed on the intermediate medium by selectively heating a phase-changeable ink. Then the intermediate image is transferred onto a recording medium, such as paper, by heating. An image forming apparatus using the intermediate transfer method can maintain the gap between the ink jet heads and a recording medium easily and obtain high-quality colored images. Moreover, an image can be positioned easily because the size of the paper does not change, i.e., does not shrink or wrinkle, due to heating.

However, the intermediate transfer method also causes a problem. For a method in which an ink image formed on the intermediate medium is heated and then transferred onto the recording medium, the ink image to be transferred onto the recording medium loses its shape because the ink image expands on the intermediate medium when it is heated.

For example, Japanese Patent Application Publication No. 7-276621 discloses an image forming apparatus with the intermediate transfer method in which the recording medium is heated rather than an ink image. First, the recording medium is heated and then the recording medium is contacted with the intermediate medium under pressure so that the ink image is transferred onto the recording medium. Because the ink image is not heated directly in this method, the ink image does not lose its shape on the intermediate medium.

However, the image forming apparatus described above also has some problems. In order to transfer the ink image onto the recording medium from the intermediate medium, a surface temperature of the intermediate medium side of a recording medium needs to be heated to a temperature equal to or higher than the softening point of the phase-changeable ink and also to a temperature equal to or higher than a specified temperature range (appropriate temperature range for transferring the phase-changeable ink). However, because the recording medium is heated from the opposite side from the side to be recorded with the intermediate image, the recording medium must be heated at higher temperature than if the recording medium was heated from the intermediate side. In this case, the side to which the ink image is to be transferred is heated through the recording medium, that is, the side that does not receive the ink image is also heated, so that the heat is wasted.

Because the intermediate medium side of the recording medium is heated from the opposite side from the intermediate medium side, it takes time to transfer heat to the intermediate medium side so that throughput is degraded.

Moreover, as a large amount of heat is applied to the recording medium, shrinking or deforming on the recording medium is likely to occur.

Furthermore, when double-sided printing is performed, another problem occurs. One side of the recording medium already has an image so that a new image is formed on the other side of the recording medium. As described above, the recording medium is heated from the opposite side from the side to be recorded the image so that the side which already has the image is heated again, that is, the phase-changeable ink forming the image is melted again. Because of this, dots forming the image are disordered or the image is transferred onto a transfer roller so that the image is damaged and the image forming apparatus and/or following recording medium get dirty, even if a high-quality image is formed on the opposite side from the side to be recorded the image. As a result of this, double-sided printing can not be performed on such image forming apparatuses.

SUMMARY OF THE INVENTION

It is an object of the invention to provide an image forming apparatus with which efficient printing can be performed such that the intermediate image using phase-changeable ink formed on the intermediate medium is transferred onto the recording sheet with less heat, double-sided printing can be performed, and high-quality images can be obtained without any damage from heat.

In order to achieve the above and other objectives, an image forming apparatus comprises an intermediate medium holding an ink image on a surface thereof, an image forming unit forming an intermediate image onto the intermediate medium using phase-changeable ink, a heating unit heating a recording medium, a press unit that brings the recording sheet being heated into contact with the intermediate image being held on the intermediate medium, and a transfer unit that transfers the intermediate image formed on the intermediate medium onto the recording sheet as a final image, wherein the heating unit heats a side to be transferred the final image of the recording medium.

The image forming apparatus which includes the structures as described above does not harm the intermediate image formed on the intermediate medium and, besides, the heating unit can heat the recording medium efficiently so that the image can be transferred with less heat because the heating unit is provided right above the recording medium in order that the side to be transferred the final image of the recording medium is heated directly. Therefore, the consumption of energy is reduced. Moreover, as described above, the recording medium is heated directly, the recording medium is heated for only a short time, therefore, throughput of the image forming apparatus can be increased and the shrink or size change on the recording medium, such as a recording sheet, is restrained. Furthermore, even though the recording medium already has images on one side using a phase-changeable ink, a new image can be formed on the other side of the recording medium without softening or melting the first images.

In one aspect of the image forming apparatus of the invention, the heating unit heats the recording medium. Heat quantity of the heating unit meets a formula $\lambda(Ts-Tr)/t$ equal to or more than Q equal to or more than $\{Cpt(Ts-Tr)/S\}+\{\lambda(Tm-Ts)/t\}$ when heat quantity per unit area which the heating unit applies to the recording medium is Q ($W/m^2$), heating time which the heating unit heats the recording medium is S (s), heat conductivity of the recording medium is $\lambda$(W/m·K), specific heat of the recording medium is C (J/kg·K), density of the recording medium is ρ (g/m3), the thickness of the recording medium is t (m), melting point of the phase-changeable ink is Tm (degrees Celsius), softening point of the hot melt ink is Ts (degrees Celsius), and the room temperature is Tr (degrees Celsius).

The heat quantity of the heating unit can be controlled in order to prevent an image from being damaged such that the side of the recording medium to be transferred the image is heated to the temperature equal to or higher than the melting point of the phase-changeable ink so that the image can be transferred onto the recording medium and the opposite side to the side to which the image of the recording sheet to be transferred is prevented from overheating so that the solidified image is not softened. Therefore, a high-quality image can be printed on both sides of the recording medium.

In another aspect of the image forming apparatus of the invention, the heating unit comprises a temperature sensor that is capable of taking a surface temperature of a side heated by the heating unit of the recording medium.

The heat unit can heat the recording medium at the proper temperature based on a temperature which is sensed by the temperature sensor because the surface temperature of the heated side of the recording medium can be taken. Therefore, high-quality image can be formed onto the recording medium without wasting heat.

In other aspect of the image forming apparatus of the invention, the heating unit includes a temperature sensor that is capable of taking a surface temperature of a side which is opposite to the side heated by the heating unit of the recording medium.

The heat unit can heat the recording medium at the proper temperature based on a temperature which is sensed by the temperature sensor because the surface temperature of a side which is opposite to the side heated by the heating unit of the recording medium can be taken. Therefore, because the surface temperature of the side which is not heated directly by the heating unit can be taken, a new image can be transferred onto the recording medium without damaging the solidified image on the other side. In particular, the temperature sensors are provided where they can take the temperature of both sides of the recording medium so that a high-quality image can be printed on both sides of the recording medium.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
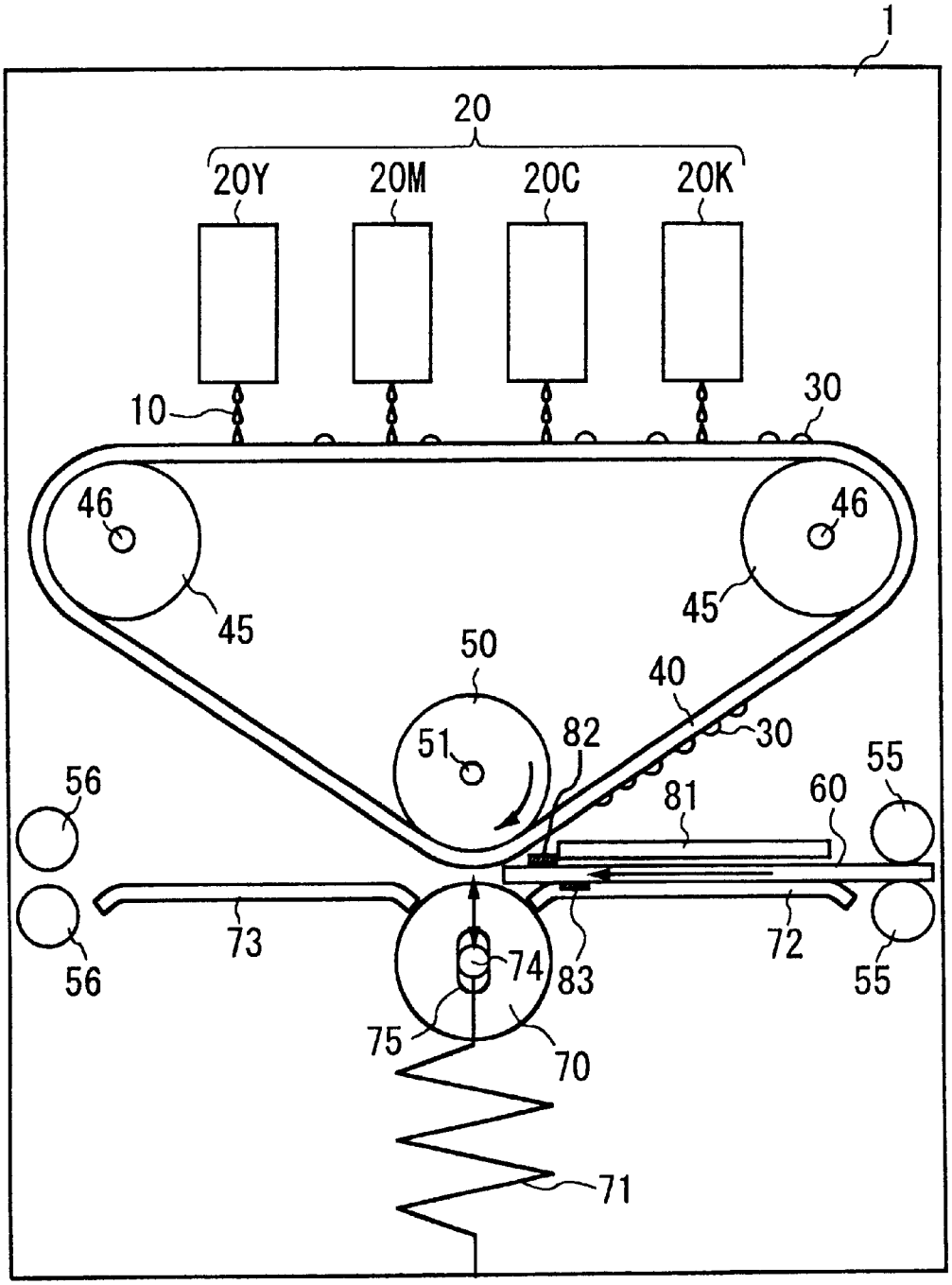
FIG. 1 is a plan view showing a configuration of an ink jet printer.

An ink jet printer 1 of the invention obtains a final image by first ejecting hot melt ink 10 from an ink jet head unit 20 onto an intermediate medium 40 in order to form an intermediate image 30 and then the intermediate image 30 is pressed by a transfer roller 50 onto a recording medium 60 which is pre-heated by a heater 81. FIG. 1 is a plan view showing a configuration of the ink jet printer 1.

The ink jet printer 1 of the invention includes the intermediate medium 40, two intermediate medium transport rollers 45, a transfer roller 50, and the head unit 20.

The intermediate medium 40 is an endless belt. The intermediate medium 40 is wound around and spans the intermediate medium transport rollers 45 and the transfer roller 50. Two intermediate medium transport rollers 45 are disposed where they are horizontal and parallel to each other. The transfer roller 50 is beneath and centered between the intermediate medium transport rollers 45 and is parallel to them.

The ink jet head unit 20 includes ink jet heads 20*y*, 20*m*, 20*c*, 20*k* arranged in order. The ink jet heads 20*y*, 20*m*, 20*c*, 20*k* store corresponding colored inks, that is, yellow ink, magenta ink, cyan ink, and black ink, respectively.

As described above, the intermediate medium 40 is wound around and spans the intermediate medium transport rollers 45 and the transfer roller 50. The ink jet heads 20*y*, 20*m*, 20*c*, 20*k* are disposed outside of the loop (above the intermediate medium 40 in FIG. 1), where their nozzles face the intermediate medium 40.

A platen roller 70 is provided under the transfer roller 50 where it is parallel to the transfer roller 50 in order to rotate with transfer roller 50. The intermediate medium 40 passes between the transfer roller 50 and the platen roller 70. A spring 71 is attached to a platen roller shaft 74 of the platen roller 70 to press the platen roller 70 against the transfer roller 50.

A stage 72 supports the recording medium 60 at the upstream side of the platen roller 70 in the sheet feed direction and a stage 73 supporting the recording medium 60 at the downstream side of the platen roller 70 with respect to the sheet feed direction as shown in FIG. 1. The stage (upstream side) 72 and the stage (downstream side) 73 are positioned where their sheet support faces are in a common horizontal plane which includes where the platen roller 70 contacts the intermediate medium 40.

A temperature sensor 83 is provided at the sheet support side of the stage (upstream side) 72 so as to contact the recording medium 60. The heater 81 is provided opposite to the sheet support side of the stage (upstream side) 72 to heat the recording medium 60. Sheet feed rollers 55 and sheet feed rollers 56 are disposed at the upstream side and the downstream side of the sheet feed direction, respectively, to feed the recording medium 60 so that the recording medium 60 is transported in the same plane as the sheet support faces of the stage (upstream side) 72 and the stage (downstream side) 73.

The ink jet printer 1 is structured as described above. Next, various aspects of the ink jet printer 1 will be described in detail.

A composition of the hot melt ink 10 used for this embodiment is as follows, and is disclosed in U.S. Pat. No. 5,560,765, by the assignee of this application. The hot melt ink composition according to this embodiment contains as a vehicle a wax that is in a solid phase at room temperature, more specially, 70% by weight of paraffin wax (Paraffin Wax Standard 155, available from Nippon Seiro Co., Ltd., Japan). The ink composition further contains 10% by weight of ethylene vinyl acetate copolymer (EVAFLEX 210, available from Dupont-Mitsui Polychemical Co., Ltd., Japan) as a resin, 8% by weight of erucic amide (DAIAMID L-200, available from Nippon Kasei Chemical Co., Ltd.) as an unsaturated fatty acid amide, 10% by weight of N-stearyl stearic amide (NIKKA AMIDE S, available from Nippon Kasei Chemical Co., Ltd.) as a saturated fatty acid amide. The dye used in the ink composition is an oil-soluble dye, more specifically, 2% by weight of C.I. Solvent Black 3 (Oil Black HHB, available from Orient Chemical Industries, Ltd., Japan) or other appropriate color. A melting point of the hot melt ink 10 used for this embodiment is 75 degrees Celsius and a softening point is 63 degrees Celsius.

In this embodiment, the heater 81 is structured that each parameter should meet the formula $\lambda(Ts-Tr)/t$ equal to or more than Q equal to or more than $\{Cpt(Ts-Tr)/S\}+\{\lambda(Tm-Ts)/t\}$ when the heat quantity per unit area which the heater 81 is applied to the recording medium 60 is Q ($W/m^2$), heating time which the heating unit heats the recording medium is S (s), heat conductivity of the recording medium is $\lambda$(W/m·K), specific heat of the recording medium is C (J/kg·K), density of the recording medium is p (g/m3), the thickness of the recording medium is t (m), the melting point of the hot melt ink is Tm (degrees Celsius), a softening point of the hot melt ink is Ts (degrees Celsius), and a room temperature is Tr (degrees Celsius). Although the hot melt ink 10 used varies according to the situation, such as the output of the heater 81 or type or size of the recording medium 60, objective temperatures, such as the melting point Tm (degrees Celsius) or the softening point Ts (degrees Celsius) of the hot melt ink 10 is obtained by adjusting the quantity of paraffin wax (Paraffin Wax Standard 155, available from Nippon Seiro Co,, Ltd., Japan) that is in a solid phase at room temperature.

Because the ink jet heads 20*y*, 20*m*, 20*c*, 20*k* are provided to be perpendicular to the recording medium 60, as shown in FIG. 1, and have a longitudinal axis substantially the same length as the width of the recording medium 60 and the intermediate medium 40 is also substantially the same width (or slightly wider) as the width of the recording medium 60. The ink jet heads 20*y*, 20*m*, 20*c*, 20*k* are fixed to the ink jet printer 1. Therefore, the ink jet printer 1 is structured as a page printer, whose ink jet heads 20*y*, 20*m*, 20*c*, 20*k* are not moved as the ink jet printer 1 forms a sheet wide one line image without moving ink jet heads 20*y*, 20*m*, 20*c*, 20*k*. It goes without saying that the ink jet printer 1 can be structured as a serial printer, whose ink jet heads 20*y*, 20*m*, 20*c*, 20*k* are moved as the ink jet printer 1 forms a sheet wide image.

Figure 7:
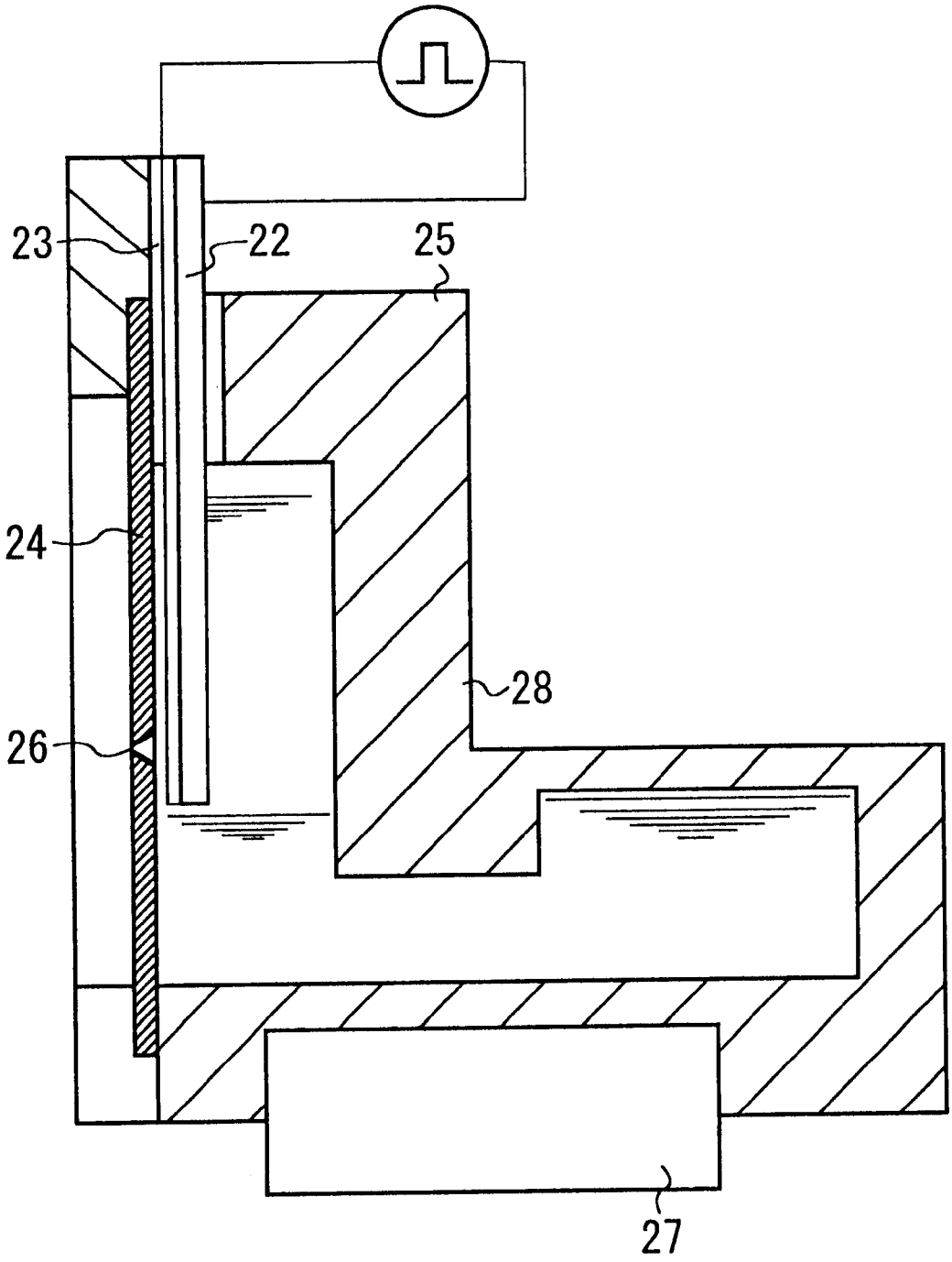
FIG. 7 is a plan view showing a cross section of an ink jet head according to an embodiment of the invention.

FIG. 7 shows the cross section of an ink jet head according to the embodiment. A frame 25 made of aluminum has a piezoelectric vibrator 22 which is unimorph type and structured having a piezoelectric material and metal thin layer. The piezoelectric vibrator 22 is fixed to a nozzle plate 24 made of a thickness of 100 $\mu$m of nickel plate with a spacer 23 made of nickel plate. The piezoelectric vibrators 22 are disposed opposite to the thin metal layer side of the nozzle plate 24. The nozzle plate 24 has a number of nozzles 26 which are extremely small holes 5 $\mu$m in diameter. An ink heater 27 is provided on the bottom of the frame 25. The hot melt ink 10 composition of the invention is described above, the hot melt ink 10 is composed of the wax and other components mainly with dye or pigment mixed.

The hot melt ink 10 stored in the heads is maintained by the ink heater 27 at a temperature at which the hot melt ink 10 has a moderate viscosity, for example, at 125 degrees Celsius in this embodiment. In order to maintain the temperature of the hot melt ink 10, the ink heater 27 is controlled based on the results of the temperature of the hot melt ink 10 which is sensed by a temperature sensor (not shown).

Next, operations performed by the ink jet printer 1 will be described. First, the hot melt ink 10 is stored in the heads as solid phase. The hot melt ink 10 is heated by the heater 27 to the specified temperature which is equal to the melting point of the hot melt ink 10 or higher, so that the hot melt ink 10 turns to the liquid phase. Then the hot melt ink 10 is carried to the piezoelectric vibrators 22 by capillary action. And then the hot melt ink 10 approaches and is held at 20 $\mu$m of the clearance between the piezoelectric vibrators 22 and the nozzle plate 24. When the hot melt ink 10 is ejected, a voltage is applied to the piezoelectric material of the specified piezoelectric vibrators 22 so that the unimorph type piezoelectric vibrators 22 are warped.

The piezoelectric vibrators 22 have a length of 2 mm and are fixed at one end. When 150 V of voltage is applied to the piezoelectric vibrators 22, the free end is deformed 15 $\mu$m. The piezoelectric vibrators 22 have elasticity so that the piezoelectric vibrators 22 are deformed toward the nozzle plate 24 when the voltage is released. This movement of the piezoelectric vibrators 22 causes pressure, which makes the hot melt ink 10 held between the free end of the piezoelectric vibrators 22 and the nozzle plate 24 eject from the nozzles 26.

Ink droplets of the hot melt ink 10 are formed onto the intermediate medium 40 in a substantially hemisphere shape and immediately cool down and solidify.

The ink jet heads 20*y*, 20*m*, 20*c*, 20*k* are disposed above the intermediate medium 40 such that the nozzle surfaces facing the intermediate medium 40 are selectively applied the voltage by a controller (not shown) based on the image information in order to melt the hot melt ink 10 in the ink jet heads 20*y*, 20*m*, 20*c*, 20*k*. The hot melt ink 10 is ejected to the specified position so that the ink image 30 is formed on the intermediate medium 40. The ink image 30 formed on the intermediate medium 40 is immediately cooled down and solidifies when its temperature goes below the freezing point of the hot melt ink 10 so as to be temporarily fixed on the intermediate medium 40.

Figure 8:
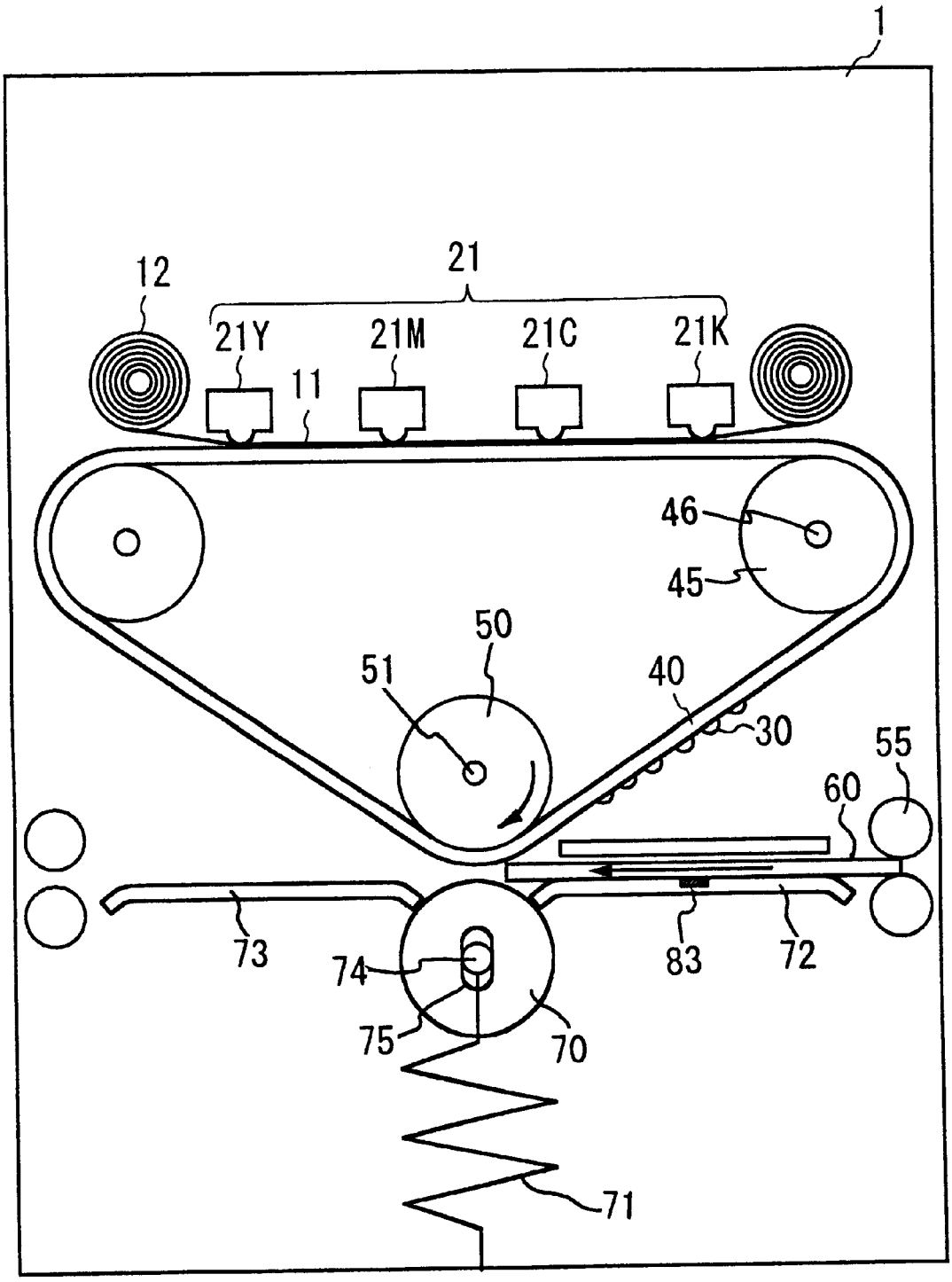
FIG. 8 is a plan view showing a modification of an embodiment of the invention. The example is a thermal printer including an ink ribbon with hot melt ink, ink ribbon reel, thermal heads, and an intermediate medium.

The ink jet printer 1 was described as the image forming device in this embodiment. However, as shown in FIG. 8, a thermal printer including a ink ribbon 11, ink ribbon reels 12, thermal head unit 21 and the intermediate medium 40 can be used. The ink ribbon reels 12 are provided to supply and wind the ink ribbon 11 carrying a hot melt ink 10. The ink ribbon 11 is selectively heated by the thermal heads 21*y*, 21*m*, 21*c*, 21*k* to form the ink image 30 onto the intermediate medium 40. The thermal head unit 21 can include four thermal heads 21*y*, 21*m*, 21*c*, 21*k* for color printing or a single head for monochromatic printing.

The intermediate medium 40 of ink jet printer 1 has an endless belt shape and is made from a nickel sheet. A thin silicon oil layer is formed over the surface of the intermediate medium 40 and the ink image 30 using the hot melt ink 10 is formed onto its surface. The intermediate medium 40 is not limited to a flexible endless belt, as shown in FIG. 1 but also shapes such as a stiff drum can be used. The materials of the intermediate medium 40 include metals, such as aluminum and stainless steel, heat-resistant resins, such as polyimide for a belt, and ceramics for a drum. Materials for the intermediate medium 40 that have a high ink-repellency can be used without any surface treatment, however, materials having a low ink-repellency need to receive the surface treatment. For example, the surface of the intermediate medium is coated with thin silicon oil layer or fluorocarbon resin such as Teflon (registered trademark of E.I. DUPONT DE NEMOURS AND COMPANY) to obtain the high ink-repellency in order to transfer images onto the recording sheet smoothly.

The intermediate medium transport rollers 45 have a cylinder shape and are substantially the same length as the width of the recording medium 60. Also, the intermediate medium transport rollers 45 are made from metal and their surfaces are covered with rubber. The intermediate medium transport rollers 45 are supported for rotation by roller shafts 46 which are positioned to be parallel to each other and disposed such that the longitudinal axis of the roller shafts 46 are perpendicular to the sheet feed direction. The intermediate medium transport rollers 45 are supplied with drive power by a drive motor 47 (FIG. 4) and a transmission mechanism (not shown) which are controlled by a print mechanism control circuit 92. The drive current supply for the print mechanism control circuit 92 is controlled by CPU 91 to regulate the rotation of the intermediate medium transport rollers 45 (refer to FIGS. 4 and 5).

The transfer roller 50 is shaped as a cylinder and is parallel to the roller shafts 46 and supported so as to be rotated by a transfer roller shaft 51. The transfer roller 50 is also supplied drive power to synchronize with the intermediate medium transport rollers 45. The intermediate medium 40, shaped as an endless belt, is wound around and spans the intermediate medium transfer rollers 45 and the transfer roller 50.

The platen roller 70 is a transfer unit that is disposed opposite the transfer roller 50 to press the intermediate medium 40 against the recording medium 60 with the transfer roller 50 so that the ink image 30 is transferred onto the recording medium 60. The platen roller 70 is supported, so as to enable it to rotate, by a platen roller shaft 74 which is positioned parallel to the transfer roller shaft 51 of the transfer roller 50. The platen roller shaft 74 is supported by a platen roller shaft bearing 75 so that the platen roller shaft 74 can move. This structure enables the platen roller 70 to contact with and separate from the intermediate medium 40. The spring 71 is attached to the platen roller shaft 74 so as to help the platen roller 70 to press against the intermediate medium 40.

In order to support the recording medium horizontally, a stage 72 supporting the recording medium 60 at the upstream side of the platen roller 70 in the sheet feed direction and a stage 73 supporting the recording medium 60 at the downstream side of the platen roller 70 in the sheet feed direction are provided as shown in FIG. 1. The stage 72 and the stage 73 sheet support faces lie in a common plane which includes the point at which the platen roller 70 contacts the intermediate medium 40.

In order to transport the recording medium 60, a pair of the sheet feed rollers 55 and a pair of the sheet feed rollers 56 are disposed at the upstream side and the downstream side of the platen roller in the sheet feed direction respectively. The sheet feed rollers 55, 56 have a cylinder shape and are substantially the same length as the width of the recording medium 60. Also, the sheet feed rollers 55, 56 are made from metal and their surfaces are covered with rubber. The sheet feed rollers 55, 56 are supported for rotation by a pair of shafts which are parallel to one other and disposed such that the longitudinal axis of the roller shafts 46 are perpendicular to the sheet feed direction. The upper rollers of the sheet feed rollers 55, 56 and the lower rollers of the sheet feed rollers 55, 56 are positioned such that their nip lies in the common horizontal plane including the sheet support side stage 72 and the stage 73 and the point where the platen roller 70 contacts with the intermediate medium 40.

The upper rollers of the sheet feed rollers 55, 56 are driven by a sheet feed motor 57 and the lower rollers of the sheet feed rollers 55, 56 are rotated with the upper rollers. The recording medium 60 is transported by the sheet feed rollers 55, 56 supplied with power from the sheet feed motor (not shown) which is supplied with current by the print mechanism control circuit 92 under control of CPU 91 (refer to FIGS. 4 and 5).

A temperature sensor (heating side) 82 and the temperature sensor (stage side) 83 are disposed so that a sensor contacts each side of the recording medium 60. A CC thermocouple having copper and Constantan contacts the surface of the recording medium 60 to take its temperature using Seebeck effect. Instead of the CC thermocouple, temperature sensors, such as thermistors, resistance thermometers, and semiconductor sensors, can be used.

Figure 2:
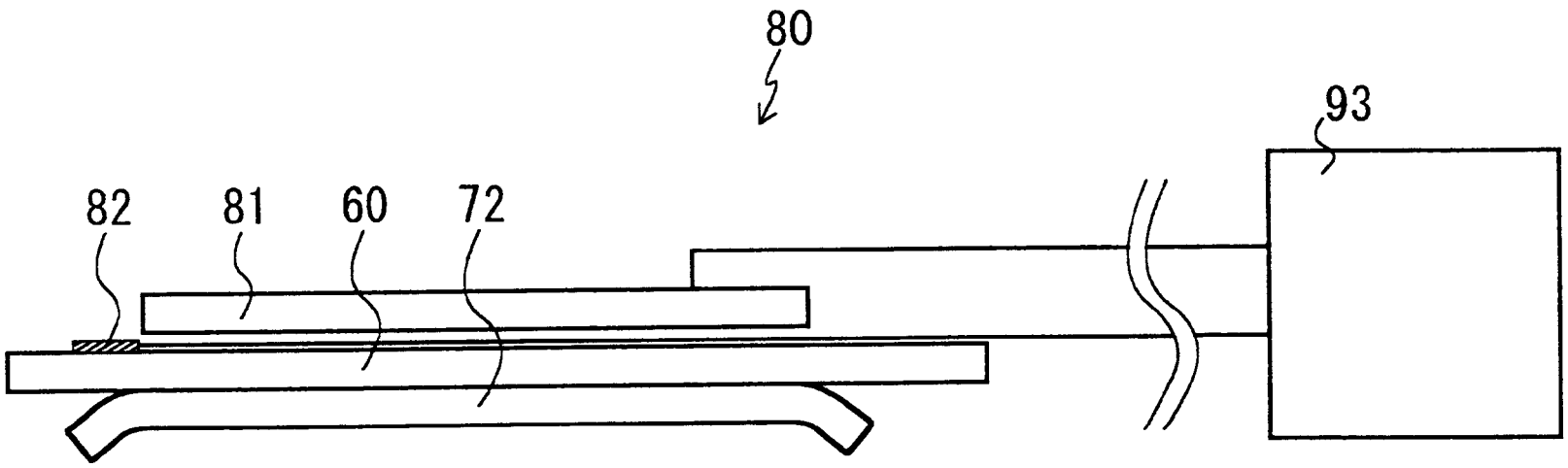
FIG. 2 is a plan view showing a schematic diagram of a part of a heating unit including a heater, a temperature sensor (heating side), and a heating unit control circuit.

FIG. 2 shows a schematic diagram of a part of a heating unit 80 including the heater 81, the temperature sensor (heating side) 82, and a heating unit control circuit 93. The heater 81 is a heating element made of a thin plate ceramic heater and is applied with a voltage by the heating unit control circuit 93 to generate heat. Although the heater 81 can be structured using dichromatic wires or tungsten halogen lamps, the ceramic heater is the most suitable material because the ceramic heater can heat up quickly and is thin so that a large space is not needed. The heat quantity of the heater 81 in this embodiment is set at $3\times10^4$ (W/m$^2$).

The recording medium 60 is transported under the heater 81 so that the surface temperature of the side to be pressed against the intermediate medium 40 of the recording medium 60 is heated to a temperature at least equal to the melting point of the hot melt ink 10. Because the melting point of the hot melt ink 10 is 75 degrees Celsius in this embodiment, the surface of the recording medium 60 is heated to be at approximately 85 degrees Celsius to allow for heat loss or cooling. The temperature used will change based upon conditions, such as room temperature Tr, the gap between the heater 81 and the recording medium 60, heat conductivity of the recording medium 60 $\lambda$(W/m·K), specific heat of the recording medium 60 C (J/kg·K), density of the recording medium 60 $\rho$(g/m$^3$), and thickness of the recording medium 60 t (m). Moreover, the heat quantity Q of the heater 81 and heating time S (s) can effect the degree of rise in temperature. The heating time can be changed by the sheet feed speed V (m/s).

As shown in FIG. 2, the ink jet printer 1 of the invention has the temperature sensor 82 provided on the heating side in order to judge whether the heating is performed according to the conditions. The temperature sensor 82 is structured as described above, and disposed at the upstream side of the platen roller 70 in the sheet transport direction. The surface temperature of the recording medium 60 is taken when the recording medium 60 is heated by the heater 81, so that the surface temperature of the recording medium 60 is obtained accurately when the final image is transferred onto the recording medium 60. Because the temperature sensor 82 needs to be protected from the direct heat of the heater 81 in order to take an accurate temperature, the heating unit 80 needs to be structured with enough space between the heater 81 and the temperature sensor 82 or with a heat insulator therebetween.

When the heating unit 80 is structured as described above, the heating unit control circuit 93 controls the heater 81 in order to heat the recording medium 60 by feedback control based on the directly measured temperature of the recording medium 60. The melting of the ink image 30 using the hot melt ink 10 formed on the intermediate medium 40 depends on whether the structure of the heater 81 meets the formula (Ts−Tr)/t equal to or more than Q, that is, when the image forming apparatus which includes the heater whose heat quantity meets the formula above is provided the ink image 30 using hot melt ink 10 formed on the intermediate medium 40 so it can be melted for transfer.

Figure 3:
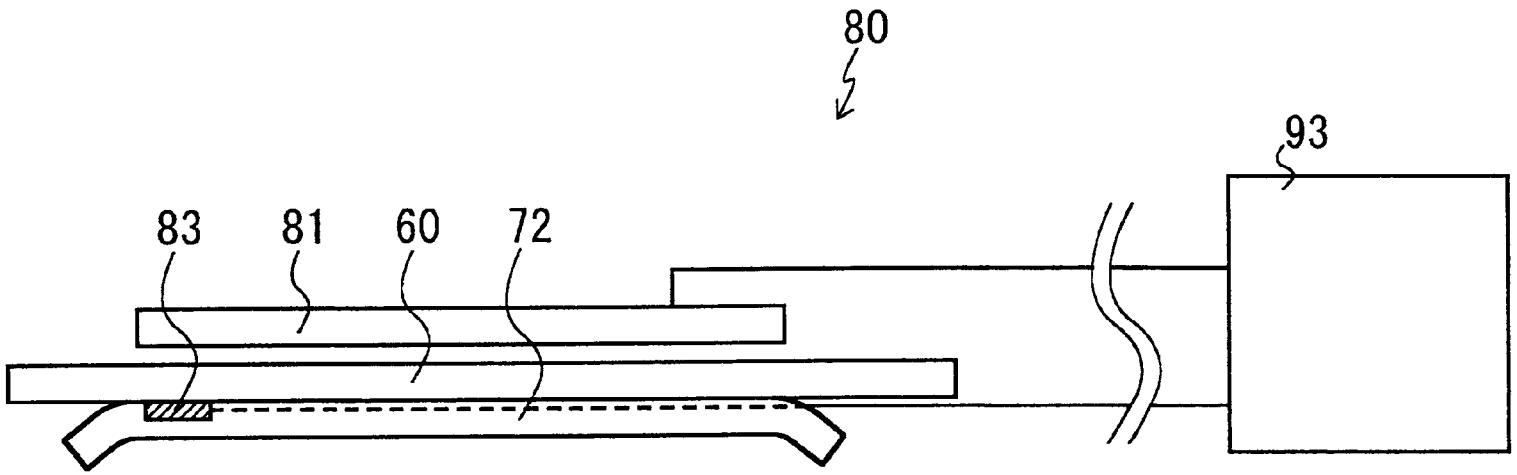
FIG. 3 is a plan view showing a schematic diagram of heating unit with a temperature sensor (stage side)

FIG. 3 is a schematic diagram of heating unit 80 with a temperature sensor 83. The temperature sensor 83 is provided at the different position than where the temperature sensor 82 is provided, i.e. it is placed on the stage side rather than the heated side. The temperature sensor 82 controls the surface temperature of the heated side of the recording medium 60 whether the surface is heated enough so as to melt the ink image 30 using the hot melt ink 10 formed on the intermediate medium 40. The temperature sensor 83, on the other hand, controls the surface temperature of the stage side of the recording medium 60 to prevent over heating and yet enable forming a new image with enough heat on the other side of the printed side which has the final image formed using the hot melt ink 10, that is, the sensor prevents the surface temperature of the stage side of the recording medium 60 from the over heating in order that the surface temperature does not rise to a temperature of the softening point or higher of the hot melt ink 10.

The image forming apparatus which does not damage the final image formed on the stage side can be produced if the image forming apparatus includes the heating unit structured such that each parameter should meet a formula λ(Ts−Tr)/t equal to or more than Q equal to or more than {Cpt(Ts−Tr)/S}+{λ(Tm−Ts)/t} when the heat quantity per unit area which the heater 81 applies to the recording medium 60 is Q ($W/m^2$), the heating time which the heating unit heats the recording medium is S (s), the heat conductivity of the recording medium is λ(W/m·K), the specific heat of the recording medium is C (J/kg·K), the density of the recording medium is ρ (g/m3), the thickness of the recording medium is t (m), the melting point of the hot melt ink is Tm (degrees Celsius), a softening point of the hot melt ink is Ts (degrees Celsius), and a room temperature is Tr (degrees Celsius). As shown in FIG. 3, the temperature sensor 83, on the stage side, is provided on the surface of the downstream side of the recording medium 60 in the sheet transport direction so that the temperature sensor 83 can take the highest temperature of the recording medium 60.

An example of the value of each parameter according to the ink jet printer 1 of this embodiment will be described. In this embodiment, the heat quantity per unit area which the heater 81 applies to the recording medium 60 is Q ($W/m^2$), the heating time which the heating unit heats the recording medium is S (s), the heat conductivity of the recording medium is λ(W/m·K), the specific heat of the recording medium is C (J/kg·K), the density of the recording medium is ρ (g/m3), the thickness of the recording medium is t (m), the melting point of the hot melt ink is Tm (degrees Celsius), a softening point of the hot melt ink is Ts (degrees Celsius), and a room temperature is Tr (degrees Celsius).

Each parameter is as described above. Substituting the parameters into the formula λ(Ts−Tr)/t equal to or more than Q equal to or more than {Cpt(Ts−Tr)/S}+{λ(Tm−Ts)/t} yields $\lambda(Ts-Tr)/t=2.28\times10^4$ and $\{Cpt(Ts-Tr)/S\}+\{\lambda(Tm-Ts)/t\}=3.69\times10^4$. Q=3×104 so that the formula above is valid. The ink jet printer 1 whose heat quantity of the heater 81 meets the formula could print images on both sides of the recording medium 60 without any problem.

Figure 4:
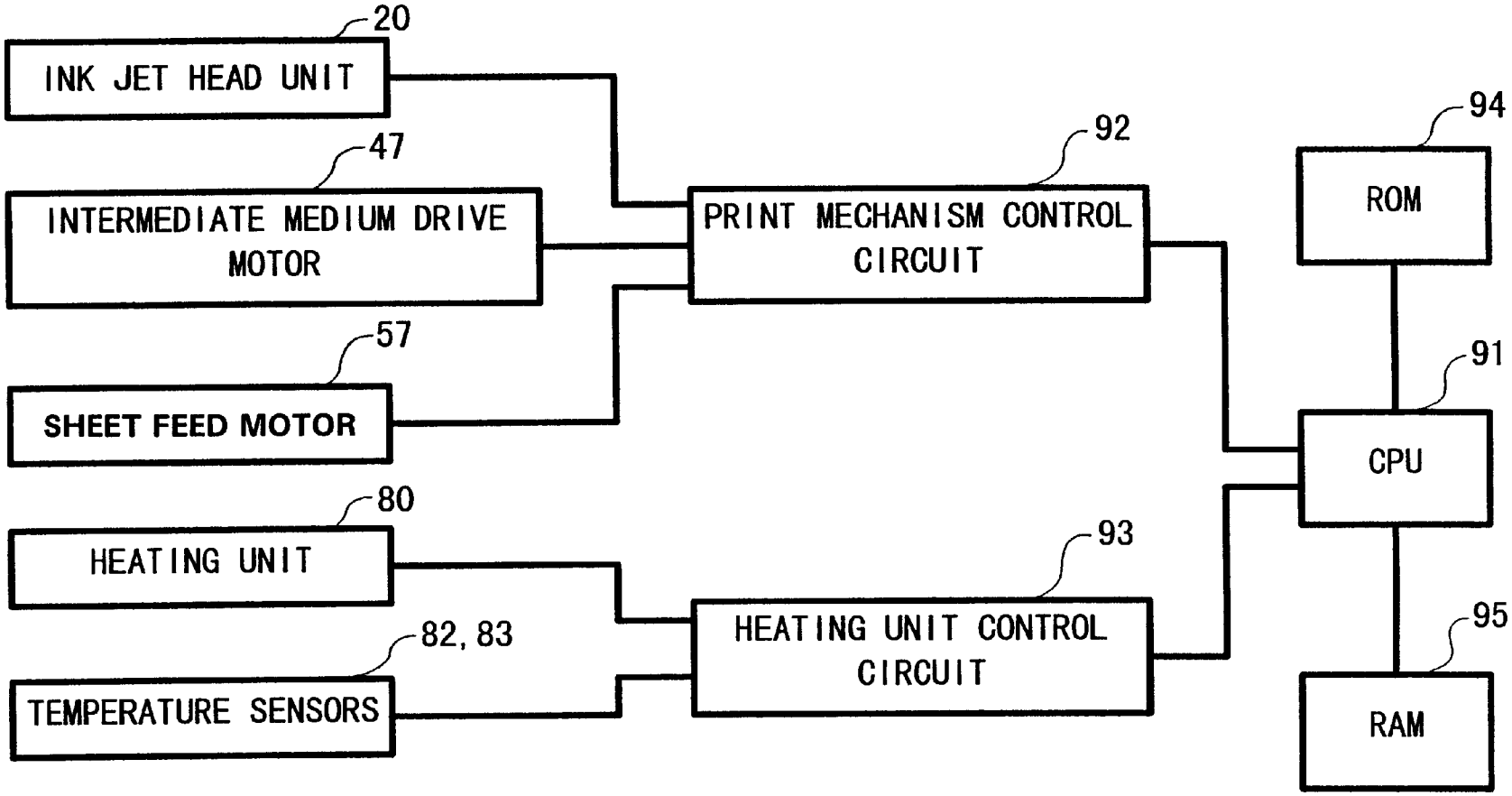
FIG. 4 is a plan view showing a block diagram of control unit of the ink jet printer.
Figure 5:
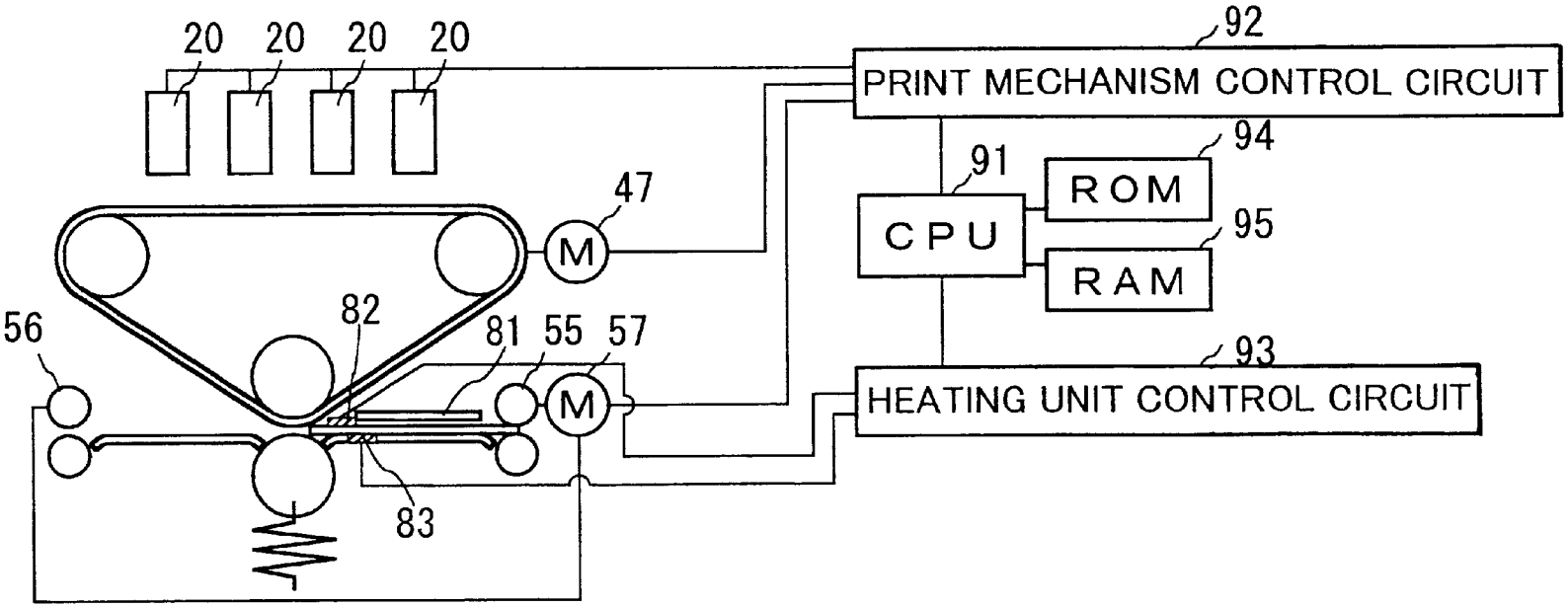
FIG. 5 is a plan view showing a schematic diagram of control unit of the ink jet printer.

FIG. 4 shows a block diagram of the control unit 90 of the ink jet printer 1 and FIG. 5 shows a schematic diagram of the control unit 90 of ink jet printer 1. The control unit 90 includes a microcomputer, of a type well-known in the art. ROM 94 and RAM 95 are connected to a CPU 91 which controls the ink jet printer 1. A control program for controlling operations of the printer is held in ROM 94. A base data for forming image is temporarily input into RAM 95 and then the base data is converted to a data for printing so that the print mechanism control circuit 92 is commanded to print. Because the print mechanism control circuit 92 has driver circuits of the ink jet heads 20*y*, 20*m*, 20*c*, 20*k*, the intermediate medium drive motor 47, and the sheet feed motor 57, the print mechanism control circuit 92 applies the specified voltage to the ink jet heads 20*y*, 2*m*, 20*c*, 20*k*, the intermediate medium drive motor 47, and a sheet feed motor 57 according to instructions from the CPU 91. Then the ink jet heads 20*y*, 2*m*, 20*c*, 20*k*, the intermediate medium drive motor 47, and the sheet feed motor 57 are driven and the ink image 30 is printed onto the recording medium 60.

While transporting the recording medium 60, the heating unit control circuit 93 applies the specified voltage to the heater 81 under the control of the CPU 91. The surface temperature of the recording side and the stage side of the recording medium 60 are sensed by the temperature sensor 82 (heating side) and the temperature sensor 83 (stage side) respectively. In order to heat the recording medium 60 at proper temperature, the feedback control is performed based on the variation of current of the temperature sensors 82, 83.

For the recording medium 60 of this embodiment, commercial copy sheet is used such that the density is 71 $g/m^2$ and thickness is approximately 100 μm, which is only one example. It goes without saying that various kinds of sheets can be used, such as sheets for an overhead projector and materials shaped like a sheet if the formula above is valid.

Next, the structure by which the ink image 30 formed on the intermediate medium 40 is transferred onto the recording medium 60 will be described.

As described above, the ink image 30 using hot melt ink 10 is formed on the intermediate medium 40 which is wound around and spans the intermediate medium transport rollers 45 and the transfer roller 50. The intermediate medium transport rollers 45 are rotated by the intermediate medium drive motor 47 (refer to FIG. 5) in order to transport the intermediate medium 40 with the ink image 30 to and around the transport roller 50, as shown in FIG. 1. In this embodiment, a process speed for the ink jet printer 1 is set at approximately 1 ppm when an A4 sheet is specified and JIS Standard is used. Therefore, the surface of the intermediate medium 40 is moved approximately five mm per second. A platen roller 70 is provided opposing the transfer roller 50. The platen roller 70 is rotatably supported by the platen roller shaft 74. A spring 71 is attached to the platen roller shaft 74 to add force so that the spring 71 helps the platen roller 70 to press against the transfer roller 50. The intermediate medium 40 and the recording medium 60 are sandwiched between the transfer roller 50 and the platen roller 70 and the pressure for sandwiching is approximately 4.4 kg.

The recording medium 60 is heated by the heater 81 while the recording medium 60 is transferred by the sheet feed rollers 55, so that the surface temperature of the recording medium 60 will be approximately 85 degrees when the recording medium 60 is in contact with the intermediate medium 40. The ink jet printer 1 can be structured with a temperature changeable unit which can change the surface temperature of the recording medium 60 according to ink used or the material of the recording medium 60.

As shown in FIG. 1, the recording medium 60 is inserted into the nip between the intermediate medium 40 and the platen roller 70 from the right side. While the recording medium 60 is transferred to the left side with the intermediate medium 40, the ink image 30 formed on the intermediate medium 40 is pressed onto the recording medium 60 by the rollers.

At that time, the surface temperature of the side facing the intermediate medium 40 of the recording medium 60 is heated to approximately 85 degrees by the heater 81, so that the hot melt ink 10 composing the ink image 30 is heated when the recording medium 60 contacts the intermediate medium 40. As a result, the hot melt ink 10 composing the ink image 30, which contacts with the recording sheet, starts melting since the surface temperature of the recording sheet is a temperature equal to or higher than the melting point of the hot melt ink 10. However, the viscosity of the melted hot melt ink 10 is decreased, i.e., becomes thinner or more fluid, the quality of the intermediate image will not be worse because the ink image 30 which contacts with the intermediate medium 40 is crushed and expanded. The ink-repellency of the intermediate medium 40 and the recording medium 60 is different. Since the recording medium 60 has low ink-repellency, the hot melt ink 10 goes into the space between fibers comprising the recording medium 60 from the intermediate medium 40 as the hot melt ink melts, and the hot melt ink 10 doesn't spread when the recording medium 60 contacts with the intermediate medium. Then the hot melt ink 10 attaches to the recording medium 60, from the intermediate medium 40, when the recording medium 60 is separated from the intermediate medium 40. After that the transference of the ink image to the recording medium 60 is completed. The transferred ink image using the hot melt ink 10 on the recording medium 60 is immediately cooled down so that the ink temperature is at its freezing point or below, to be fixed on the recording medium 60. Because the silicon oil layer is formed on the surface of the intermediate medium 40 to obtain high ink-repellency, the ink image 30 will be completely transferred from the intermediate medium 40. Then the intermediate medium 40 is transported by the intermediate transport rollers 45 so that new ink image 30 can be formed.

Figure 6:
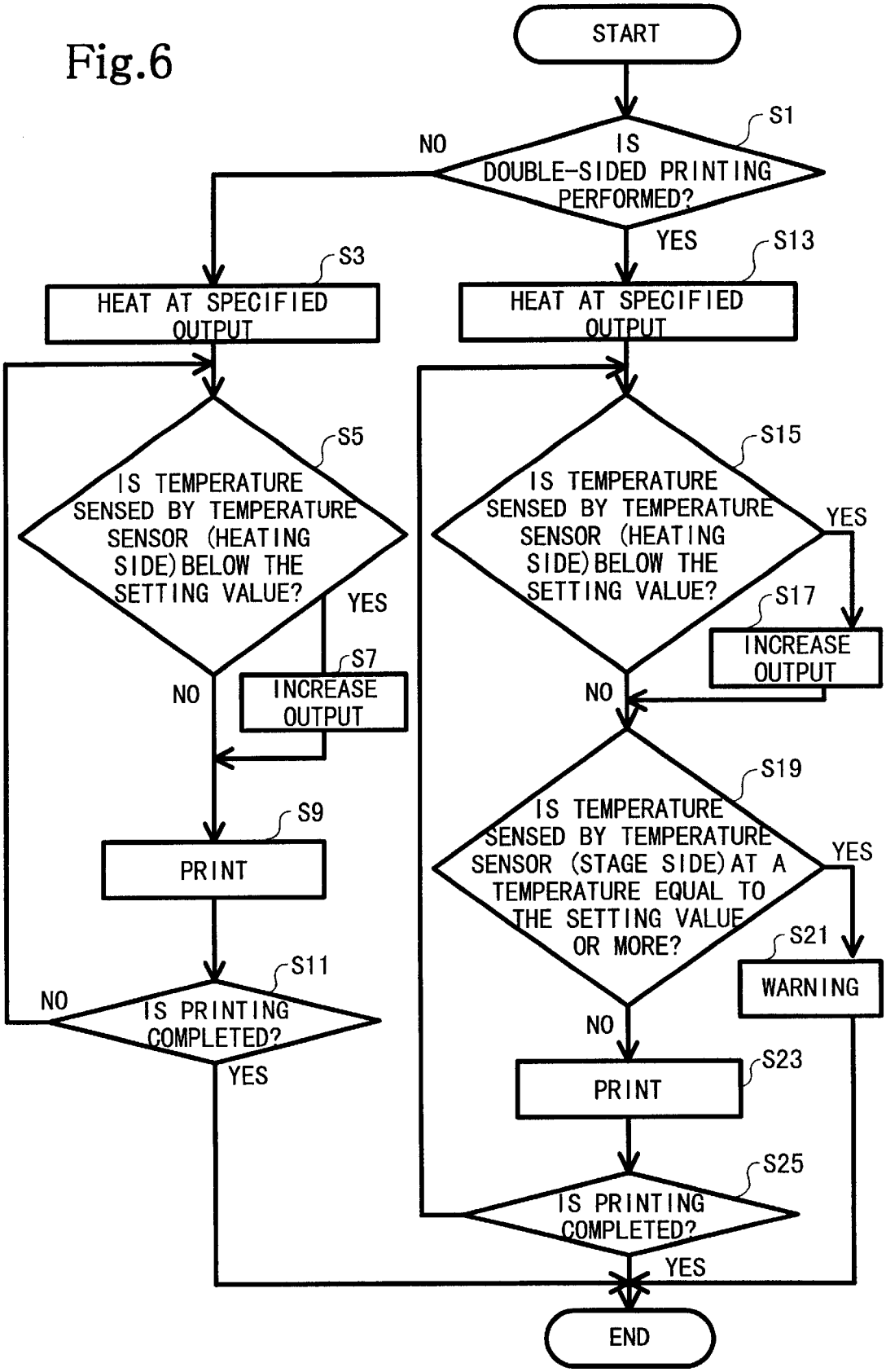
FIG. 6 is a flowchart of control system of heating unit of the ink jet printer according to an embodiment of the invention.

FIG. 6 shows a flowchart for control of the heating unit 80 of the ink jet printer 1 according to the embodiment. First, before printing is performed, a print type should be entered using an operation unit (not shown), that is, whether single-sided printing or double-sided printing is to be performed.

When single-sided printing is performed (Step 1:NO), the recording medium 60 is heated by the specified output as it is inserted into the ink jet printer 1 (Step 3). The surface temperature of the side to be recorded of the recording medium 60 is sensed by the temperature sensor 82 (heating side), and the result is judged whether the surface temperature of the recording medium 60 has reached the setting value. If the surface temperature of the recording medium 60 is below the setting value (Step 5:YES), CPU 91 calculates the output necessary from deviation of the setting value and the measured value. After the heating unit control circuit 93 controls the heater 81 to increase the output (Step 7), the printing is performed (Step 9).

When the surface temperature of the recording medium 60 is beyond the setting value (Step 5:NO), the printing is performed (Step 9). The surface temperature of the recording side of the recording medium 60 is taken until the printing is completed (Step 11:NO). When the printing is finished according to the print data (Step 11:YES), the heating by the heater 81 is stopped (End).

For single-sided printing, the surface temperature of the side to be recorded of the recording medium 60 is controlled so that the surface temperature of the recording medium 60 is at the specified temperature or higher (step 1 thorough 11) so that the ink image 30 is only heated with a high enough temperature to transfer. The heater 81 is controlled to supply enough heat so that high speed print can be performed efficiently. However, for double-sided printing, the ink image on the printed side will be damaged if the side to be recorded of the recording medium 60 is overheated. To prevent the overheating, a different control is performed, which will now be described.

When one side of the recording medium 60 is already printed using the ink jet printer described above and the other side is to be printed, that is, when double-sided printing is to be performed, the information that double-sided printing will be performed using the operation unit (not shown) is input (S1:YES).

When double-sided printing is selected, the recording medium 60 is heated by the specified output as it is inserted into the ink jet printer 1 (Step 13). The surface temperature of the side to be recorded of the recording medium 60 is sensed by the temperature sensor 82 (heating side), and the result is judged whether the surface temperature of the recording medium 60 has reached the setting value. If the surface temperature of the recording medium 60 is below the setting value (Step 15:YES), the CPU 91 calculates the output necessary from deviation between the setting value and the measured value. After the heating unit control circuit 93 controls the heater 81 to increase the output (Step 17), printing is performed.

The different control is performed for double-sided printing. The surface temperature of the printed side of the recording medium 60 is sensed by the temperature sensor 83 (stage side). When the surface temperature of the recording medium 60 is below the softening point of the hot melt ink 10 (Step 19:NO), the printing is performed (Step 23). While the surface temperature of the recording side of the recording medium 60 is taken (Step 15 and Step 19), the heater continues heating until the printing is completed (Step 25:YES). When the printing is finished according to the print data (Step 25 YES), the heating by the heater 81 is stopped (End).

Since the ink jet printer 1 includes the structures and operations as described above, efficient printing can be performed such that the intermediate image using hot melt ink formed on the intermediate medium is transferred onto the recording sheet with less heat. Moreover, high-quality images can be obtained without any damage from heat and also double-sided printing can be performed.

It is to be understood that the invention is not restricted to the particular forms shown in the foregoing embodiment. Various modifications and alterations can be made thereto without departing from the scope of the invention.

What is claimed is:

1. An image forming apparatus, comprising:

an intermediate medium holding an ink image on a surface thereof;

an image forming unit forming an intermediate image onto the intermediate medium using phase-changeable ink;

a heating unit heating a recording medium;

a press unit that brings the recording medium being heated into contact with the intermediate image held on the intermediate medium; and a transfer unit that transfers the intermediate image formed on the intermediate medium onto the recording medium as a final image, wherein the heating unit heats a surface of the recording medium to which the final image is to be transferred, to a temperature above a melting point of the ink, from a side of the surface of the recording medium to which the final image is to be transferred.

2. The image forming apparatus according to claim 1, wherein the heating unit heats the recording medium, the heating unit structured that each parameter meets a formula $\lambda(Ts-Tr)/t$ equal to or more than Q equal to or more than $\{C\rho t(Ts-Tr)/S\}+\{\lambda(Tm-Ts)/t\}$ when heat quantity per unit area which the heating unit applies to the recording medium is Q ($W/m^2$), heating time which the heating unit heats the recording medium is S (s), heat conductivity of the recording medium is $\lambda$(W/m·K), specific heat of the recording medium is C (J/kg·K), density of the recording medium is $\rho$ (g/m3), thickness of the recording medium is t (m), a melting point of the phase-changeable ink is Tm (degrees Celsius), a softening point of hot melt ink is Ts (degrees Celsius), and room temperature is Tr (degrees Celsius).

3. The image forming apparatus according to claim 1, wherein the heating unit comprises a temperature sensor for taking a surface temperature of a surface of the recording medium heated by the heating unit.

4. The image forming apparatus according to claim 1, wherein the heating unit comprises a temperature sensor for taking a surface temperature of a surface of the recording medium which is opposite to the surface of the recording medium heated by the heating unit.

5. A process for printing on a recording medium using a heat sensitive ink, comprising the steps of:

melting the ink and forming an image on an intermediate medium;

transporting the image on the intermediate medium to a transfer position;

preheating a surface of a recording medium;

sensing the temperature of the preheated surface of the recording medium;

transporting the recording medium to the transfer position; and concurrently transporting the image and the recording medium to transfer the image to the recording medium, wherein the preheating of the surface is to a temperature above the melting point of the ink on the intermediate medium and done from a side of the surface of the recording medium to which the image is to be transferred.

6. The process according to claim 5, further comprising a step of determining if double sided printing on the recording medium is to occur.

7. The process according to claim 6, further comprising a step of increasing an output of a heater when the step of sensing the temperature of the preheated surface of the recording medium is below a specified temperature.

8. The process according to claim 7, further comprising steps of:

sensing a temperature of a surface of the recording medium opposite to the preheated surface; and issuing a warning if the temperature of the surface opposite the preheated surface is greater than the specified temperature.

9. The processing according to claim 8, wherein the specified temperature is the melting point of the ink plus a predetermined number of degrees to allow for cooling during movement from a preheating position to the transfer position.

10. The process according to claim 5, further comprising a step of increasing an output of a heater when the step of sensing the temperature of the preheated surface of the recording medium is below a specified temperature.

11. An apparatus for printing on a recording medium using a heat sensitive ink, comprising:

means for melting the ink and forming an image on an intermediate medium;

first means for transporting the image on the intermediate medium to a transfer position;

means for preheating a surface of a recording medium to receive the image;

means for sensing the temperature of the preheated surface of the recording medium;

second means for transporting the recording medium to the transfer position; and means for concurrently transporting the image and the recording medium to transfer the image to the recording medium, wherein the means for preheating heats the surface of the recording medium to a temperature above the melting point of the ink, on the intermediate medium, from a side of the surface of the recording medium to which the image is to be transferred.

12. The apparatus according to claim 11, further comprising means for determining if double sided printing on the recording medium is to occur.

13. The apparatus according to claim 12, further comprising means for increasing an output of the means for preheating when the means for sensing senses the temperature of the preheated surface of the recording medium is below a specified temperature.

14. The apparatus according to claim 13, further comprising:

second means for sensing a temperature of a surface of the recording medium opposite to the preheated surface; and means for issuing a warning if the temperature of the surface opposite the preheated surface is greater than the specified temperature.

15. The apparatus according to claim 14, wherein the specified temperature is the melting point of the ink plus a predetermined number of degrees to allow for cooling during movement from a preheating position to the transfer position.

16. The apparatus according to claim 11, further comprising means for increasing an output of the means for preheating when the means for sensing senses the temperature of the preheated surface of the recording medium is below a specified temperature.

17. An image forming apparatus, comprising:

an intermediate medium holding an ink image on a surface thereof;

an image forming unit forming an intermediate image onto the intermediate medium using phase-changeable ink;

a heating unit heating a recording medium;

a press unit that brings the recording medium being heated into contact with the intermediate image held on the intermediate medium; and a transfer unit that transfers the intermediate image formed on the intermediate medium onto the recording medium as a final image, wherein the heating unit heats a surface of the recording medium to which the final image is to be transferred, wherein the heating unit heats the recording medium, the heating unit structured that each parameter meets a formula $\lambda(Ts-Tr)/t$ equal to or more than Q equal to or more than $\{C\rho t(Ts-Tr)/S\}+\{\lambda(Tm-Ts)/t\}$ when heat quantity per unit area which the heating unit applies to the recording medium is Q ($W/m^2$), heating time which the heating unit heats the recording medium is S (s), heat conductivity of the recording medium is $\lambda$(W/m·K), specific heat of the recording medium is C (J/kg·K), density of the recording medium is $\rho$ ($g/m^3$), thickness of the recording medium is t (m), a melting point of the phase-changeable ink is Tm (degrees Celsius), a softening point of hot melt ink is Ts (degrees Celsius), and room temperature is Tr (degrees Celsius).

18. The image forming apparatus according to claim 17, wherein the heating unit comprises a temperature sensor for taking a surface temperature of the surface of the recording medium heated by the heating unit.

19. The image forming apparatus according to claim 17, wherein the heating unit comprises a temperature sensor for taking a surface temperature of a surface of the recording medium which is opposite to the surface of the recording medium heated by the heating unit.

20. A process for printing on a recording medium using a heat sensitive ink, comprising the steps of:

melting the ink and forming an image on an intermediate medium;

transporting the image on the intermediate medium to a transfer position;

preheating a surface of a recording medium to receive the image to a temperature above the melting point of the ink on the intermediate medium;

sensing the temperature of the preheated surface of the recording medium;

transporting the recording medium to the transfer position;

concurrently transporting the image and the recording medium to transfer the image to the recording medium, wherein preheating the surface of the recording medium by applying heat of which the heat quantity per unit area Q satisfies a formula $\lambda(Ts-Tr)/t$ equal to or more than Q equal to or more than $\{C\rho t(Ts-Tr)/S\}+\{\lambda(Tm-Ts)/t\}$ when the heat quantity per unit area which the heating unit applies to the recording medium is Q ($W/m^2$), heating time which the heating unit heats the recording medium is S (s), heat conductivity of the recording medium is $\lambda$(W/m·K), specific heat of the recording medium is C (J/kg·K), density of the recording medium is $\rho$ ($g/m^3$), thickness of the recording medium is t (m), a melting point of the phase-changeable ink is Tm (degrees Celsius), a softening point of hot melt ink is Ts (degrees Celsius), and room temperature is Tr (degrees Celsius).

21. An apparatus for printing on a recording medium using a heat sensitive ink, comprising:

means for melting the ink and forming an image on an intermediate medium;

first means for transporting the image on the intermediate medium to a transfer position;

means for preheating a surface of a recording medium to receive the image to a temperature above the melting point of the ink on the intermediate medium;

means for sensing the temperature of the preheated surface of the recording medium;

second means for transporting the recording medium to the transfer position; and means for concurrently transporting the image and the recording medium to transfer the image to the recording medium, wherein the means for preheating heats the surface of the recording medium by applying heat of which the heat quantity per unit area Q satisfies a formula $\lambda(Ts-Tr)/t$ equal to or more than Q equal to or more than $\{C\rho t(Ts-Tr)/S\}+\{\lambda(Tm-Ts)/t\}$ when heat quantity per unit area which the heating unit applies to the recording medium is Q ($W/m^2$), heating time which the heating unit heats the recording medium is S (s), heat conductivity of the recording medium is $\lambda$(W/m·K), specific heat of the recording medium is C (J/kg·K), density of the recording medium is $\rho$ ($g/m^3$), thickness of the recording medium is t (m), a melting point of the phase-changeable ink is Tm (degrees Celsius), a softening point of hot melt ink is Ts (degrees Celsius), and room temperature is Tr (degrees Celsius).

* * * * *